US006299386B1

(12) United States Patent
Byrne et al.

(10) Patent No.: US 6,299,386 B1
(45) Date of Patent: Oct. 9, 2001

(54) METHOD AND APPARATUS FOR A SHORING WALL

(76) Inventors: R. John Byrne, 15704 NE. 157th St., Woodinville, WA (US) 98072; Chris J. Wolschlag, 16340 NE. 83rd St., Apt. A310, Redmond, WA (US) 98052

( * ) Notice: Subject to any disclaimer, the term of this patent is extended or adjusted under 35 U.S.C. 154(b) by 0 days.

(21) Appl. No.: 09/328,867

(22) Filed: Jun. 9, 1999

(51) Int. Cl.[7] ..... E02D 5/20; E02D 17/20

(52) U.S. Cl. ..... 405/273; 405/272; 405/284; 405/286; 405/262

(58) Field of Search ..... 405/262, 284, 405/272, 273, 286, 287, 258.1, 275

(56) References Cited

U.S. PATENT DOCUMENTS

| | | | | |
|---|---|---|---|---|
| Re. 28,977 | | 9/1976 | Mason | 61/39 |
| 1,747,038 | | 2/1930 | Weber . | |
| 3,638,435 | | 2/1972 | Mason | 61/39 |
| 3,802,204 | | 4/1974 | Mason | 61/39 |
| 4,561,804 | | 12/1985 | Weatherby | 405/262 |
| 4,848,972 | | 7/1989 | Trevisani | 405/262 |
| 4,911,582 | | 3/1990 | Peirce, Jr. et al. | 405/262 |
| 4,911,583 | | 3/1990 | Carey | 405/262 |
| 4,917,543 | * | 4/1990 | Cole et al. | 405/262 |
| 4,952,097 | | 8/1990 | Kulchin | 405/262 |
| 5,158,399 | | 10/1992 | Flores | 405/285 |
| 5,195,849 | * | 3/1993 | Stapleton | 405/272 |
| 5,244,316 | * | 9/1993 | Wright et al. | 405/284 |
| 5,395,185 | | 3/1995 | Schnabel, Jr. | 405/287 |
| 5,456,554 | | 10/1995 | Barrett et al. | 405/284 |
| 5,551,810 | | 9/1996 | Franceski et al. | 405/286 |
| 5,588,784 | | 12/1996 | Brandl et al. | 405/262 |

FOREIGN PATENT DOCUMENTS

| | | | | |
|---|---|---|---|---|
| 683898 | * | 4/1964 | (CA) | 405/262 |
| 2201950 | * | 7/1973 | (DE) | 405/262 |
| 2100325 | * | 12/1982 | (GB) | 405/262 |
| 59-80822 | | 5/1984 | (JP) | E02D/17/04 |
| 0038015 | * | 2/1986 | (JP) | 405/262 |
| 404052319 | * | 2/1992 | (JP) | 405/262 |
| 6/257135 | | 9/1994 | (JP) | E02D/3/12 |
| 8604103 | * | 7/1986 | (WO) | 405/262 |

OTHER PUBLICATIONS

"Construction methods: Contractor's Innovative System Stands Alone in Site Testing," *ENR,* Jun. 15, 1998.

"The VERT™ System" brochure, Geo–Con, Monroevill, PA (undated).

* cited by examiner

*Primary Examiner*—Thomas B. Will
*Assistant Examiner*—Alexandra K. Pechhold
(74) *Attorney, Agent, or Firm*—Stratton Ballew PLLC

(57) ABSTRACT

A retaining element system is provided that improves face stability in poorer quality soils that are not suited to conventional soil nailing. The method includes inserting retaining elements substantially vertically into an earthen mass to shore the face of an excavation. The earthen mass can be any material or combination of materials, such as soil, clay or rock that requires excavation for the installation of a shoring wall. The plurality of retaining elements are placed side by side in a substantially linear arrangement. A plurality of soil nails are then inserted into the excavation plane, at the approximate midpoint between a pair of adjacent retaining elements. An exposed tip portion of each soil nail attaches to a wale, which is a substantially horizontal element that contacts a retaining element on both sides of each soil nail. The wale can be a beam, bracket, or a set of concrete reinforcement bars. The beam or bracket can either be a structural member, formed of steel or the like, or alternatively formed from a precast concrete. The concrete reinforcement bars can then receive a concrete fill to form a solid wale structure. Face stability is achieved with the pre-installed retaining elements, which with the wales provide complete facing support.

12 Claims, 9 Drawing Sheets

METHOD AND APPARATUS FOR A SHORING WALL

TECHNICAL FIELD

The invention relates to a method and apparatus for a wall that retains earthen material, and more particularly to a shoring wall for below-grade excavations.

BACKGROUND OF THE INVENTION

Soil nailing is a cost-effective method of in situ ground reinforcement, in which passive, or non pre-stressed reinforcing elements are installed into the ground and attached to a facing of reinforced shotcrete or concrete. The cost effectiveness of soil nailing depends in part on the ability of vertical cuts in the ground to stand unsupported for a sufficient length of time to allow erection of the face reinforcing steel and subsequent application with shotcrete. The length of time that a vertical face can stand unsupported is referred to as "stand-up time." When the stand-up time of vertical cuts at the face is limited, face stability problems do not allow economical soil nail wall construction. These situations typically require alternative, more costly wall systems, such as soldier piles, sheet piles or tieback walls.

U.S. Pat. No. 3,802,204 to Mason teaches the early use of tendon rods or dowels, inserted into an embankment to aid in the support of a temporary retaining wall, as an alternative to sheet pilings. An additional feature of the Mason '204 retaining wall is that Mason '204 teaches the use of horizontal concrete wale beams that include reinforcing rods. Mason '204 also teaches the use of pneumatically delivered concrete. Pneumatically delivered concrete is also called "shotcrete" or "gunnite," and can be fiber reinforced for additional strength. However, the wale beams of Mason '204 fail to provide any vertically oriented support for the soil reinforcing rods that extend back horizontally into the excavation. Therefore, there is a need for a retaining wall system that provides a simple and economical, vertical and horizontal support for an excavated wall.

U.S. Pat. No. 4,911,583 to Carey teaches the addition of vertical rods, drilled into the ground along the face of an excavation, to provide an improved retaining wall. The Carey '583 disclosure teaches only the use of vertical rods with soft shale rock or "stiff soil." The vertical rods are taught by Carey '583 as better able to help define the face of an excavation in these stiff soils, compared to soldier piles. Carey '583 teaches the placement of the vertical rods at two to four foot centers. This placement may eliminate the need for larger diameter soldier piles or wide soldier sheet piles. However, Carey '583 fails to teach any method that is applicable to softer soils. A retaining wall system is needed for soils that are not stable enough to remain in place with simply vertical rods and separate, conventional horizontal anchors.

U.S. Pat. No. 4,952,097 to Kulchin teaches the use of steel plates placed over the proximal ends of soil anchoring rods. The steel plates are mounted next to a grid of rebar so that the tensile strength of the soil anchors provides reenforcement to the rebar grid, which receives shotcrete to form a permanent concrete wall. FIG. 2 of Kulchin '097 shows this grid of rebar used to reinforce the concrete wall. A problem with Kulchin '097 is that the rebar grid relies on the soil anchors for substantially all of the wall's support. To provide the "permanent" retaining wall, as described by Kulchin '097, a substantial footing is also required to prevent the base of the wall from "kicking out," especially in unstable and high water content soils. The footing is a costly addition to a retaining wall. A permanent retaining wall system is needed that can shore an excavation of unstable soils without the need for additional trenching along the base of the excavated wall for receiving a large and costly foundation.

U.S. Pat. No. 5,456,544 to Barrett et al. teaches a vertical wall support system that includes a horizontal pipe extending from a vertical pipe to form an L-shaped member for supporting a wall, as shown in FIG. 17, therein. The L-shaped member of Barrett '544 requires a foundational layer of concrete and geofabric over-layers to support and maintain the horizontal pipe in position. Such additional reinforcements are undesirable in that they are time consuming and expensive to install and require extensive excavation and backfilling as compared to prior retaining wall systems that primarily rely on the horizontal soil anchors alone. However, these horizontal soil anchors cannot provide an additional level of vertically oriented support, as needed for softer soils. Therefore, a retaining wall system that can bear vertical and horizontal loads is needed that can simply and economically provide horizontal anchoring and vertical support for a shoring wall.

SUMMARY OF INVENTION

The retaining element system of the present invention is designed to improve face stability in poorer quality soils that are not suited to conventional soil nailing. A method for shoring a face of an excavation is provided that includes inserting a plurality of retaining elements substantially vertically into an earthen mass. The earthen mass can be any material or combination of materials, such as soil, clay or rock that requires excavation for the installation of a shoring wall. The earthen mass has an upper surface, which can be referred to as a "grade." Preferably, this insertion of the retaining elements into the earthen mass is achieved by drilling a plurality of vertical holes, each for receiving one of the plurality of retaining elements. Most preferably, a grout mixture is poured into each of the holes to firmly anchor each of the retaining elements into the earthen material below the grade.

The plurality of retaining elements are placed side by side in a substantially linear arrangement, when viewed along the grade, to define an excavation plane. The excavation plane lies below the grade and because the retaining elements are substantially vertical and the grade is substantially level, the excavation plane is substantially perpendicular to the grade. At least a portion of each retaining element is exposed by excavating along the excavation plane. This exposed surface is the excavated side of the excavation plane. A plurality of soil nails are then inserted into the excavation plane, at the approximate midpoint between a pair of adjacent retaining elements. A tip portion of each soil nail remains exposed on the excavated side of the excavation plane.

This exposed tip portion of each soil nail is employed for attachment to a wale. The wale is a substantially horizontal element that also contacts each retaining element of the pair of adjacent retaining elements on both sides of each soil nail. The wale can be a beam, bracket, or a set of concrete reinforcement bars. The beam or bracket can either be a structural member, formed of steel or the like, or alternatively formed from a precast concrete. The concrete reinforcement bars can then receive a concrete fill to form a solid wale structure.

A lagging matrix can then be constructed proximate to the exposed surface of the excavation plane and preferably attached to the retaining elements along the excavation plane. The lagging matrix is a conventionally constructed system of internal reinforcement bars and supports for a concrete wall. The lagging matrix receives a concrete slurry. The concrete slurry is a concrete mixture that is sufficiently liquid to be deposited or poured into the lagging matrix to form a shoring wall. Preferably, the concrete mixture is pneumatically conveyed shot-crete.

For soils with moderate stability problems along the excavation plane, or cut face, a drill berm is preferably formed along the excavation plane. The drill berm aids in the placement of the soil nails and preserves the earthen material along the excavation plane. The drill berm is then removed after the soil nails are inserted into the excavation plane.

According to an aspect of the invention, a retaining or shoring wall system is described that is simple and economical and provides both vertical and horizontal support.

According to another aspect of the invention, a shoring wall system is provided for use with soils that are not stable enough to remain in place with only conventional, horizontal anchors and independent vertical rods.

According yet another aspect of the invention, a permanent retaining wall system is provided that can shore an excavation of unstable soils without the need for additional trenching along the base of the excavated wall to fit the wall with a large and costly foundation.

According still another aspect of the invention, a retaining wall system with vertical and horizontal load bearing is provided that can simply and economically provide horizontal anchoring and vertical support for a shoring wall.

The present invention's uses vertically oriented reinforcement elements that are pre-installed prior to the start of excavation and wall construction to provide localized support to the exposed face. These vertically oriented reinforcement elements improve stand-up time and allow face closure with reinforced shotcrete or other techniques to be implemented. In addition to the face stability achieved with the pre-installed retaining elements, the construction technique of the present invention employs a system of structural wales which, in conjunction with the retaining elements, provides a complete facing support. The installation of the present invention is very versatile, without any requirement for vertical steel continuity in the facing except for the retaining elements, and with a virtually complete disassociation of the face closure and soil nail installation activities. The method of the invention lends itself to modularization, adaptable to the details of the construction method, such as height of the face closure lifts, vertical location and spacing of individual retaining elements, to suit the ground conditions.

DETAILED DESCRIPTION OF SPECIFIC EMBODIMENTS

Figure 1:
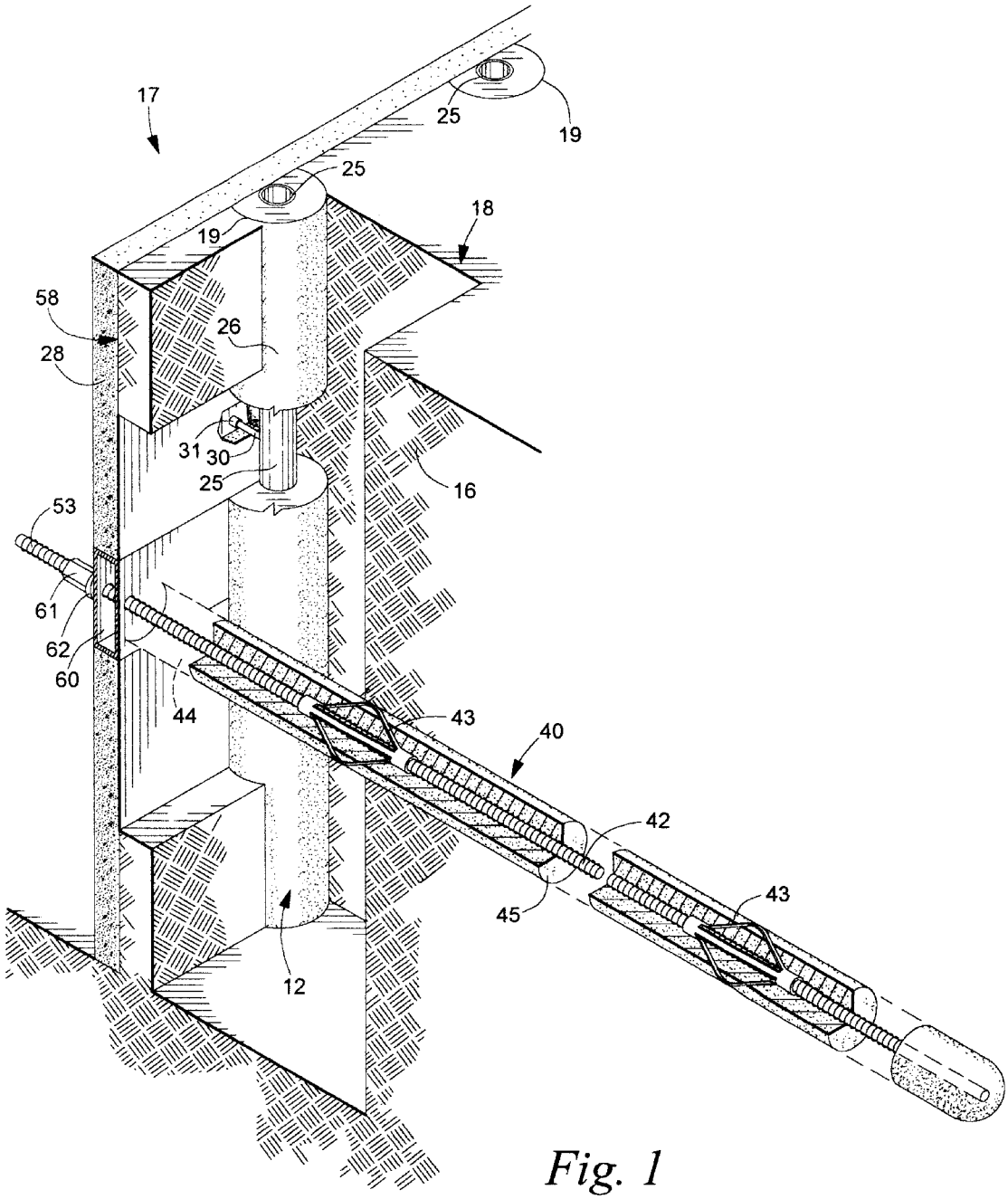
FIG. 1 is a partially sectioned perspective view of a shoring wall, according to an embodiment of this invention.

The invention provides a method and apparatus for a wall system that retains earthen material. The wall system is particularly suited to shoring below grade excavations of softer and less stable soils, gravels and sandy materials.

The method and apparatus for shoring a face of an excavation is shown in FIGS. 1 through 10. A preferred method comprises first inserting a plurality of retaining elements 12 into an earthen mass 16. The earthen mass can be any material or combination of earthen materials, such as soil, clay or rock that requires excavation for the installation of a shoring wall 17.

The earthen mass 16 includes a grade 18, which is the upper surface of the earthen mass. As detailed in FIG. 3, each of the retaining elements 12 are inserted into a bore hole 19 along a wall line 20, which runs along the grade at what will be the top edge 21 of the shoring wall. The retaining elements are inserted along the final wall line in a substantially vertical orientation to define an excavation plane 22 along the shoring wall, substantially perpendicular to the grade. The size of the bore holes will be determined in part by the diameter of the retaining element required to allow soil arching between pairs of adjacent retaining elements. To maximize stability in the excavated earthen mass, the retaining elements are preferably installed prior to the start of excavation and construction of the shoring wall.

As detailed in FIG. 1, each retaining element 12 is composite in structure and preferably contains a retainer core 25 surrounded by a retainer grout sheath 26. Preferably, as shown in FIGS. 1, 2, 4 and 6, the retainer core is a segment of pipe and most preferably a structural steel pipe. The retainer grout sheath is preferably a lean and easy flowing concrete mixture that is poured into each retainer bore hole 19 after the retainer core is inserted into it. As an alternative to the steel pipe retainer core, the retaining element can have a retainer core of rebar, with either a single rebar segment or multiple rebar core elements. As an additional alternative, a structural beam retainer core, such as an I-beam, or a channel beam can be utilized.

Figure 3:
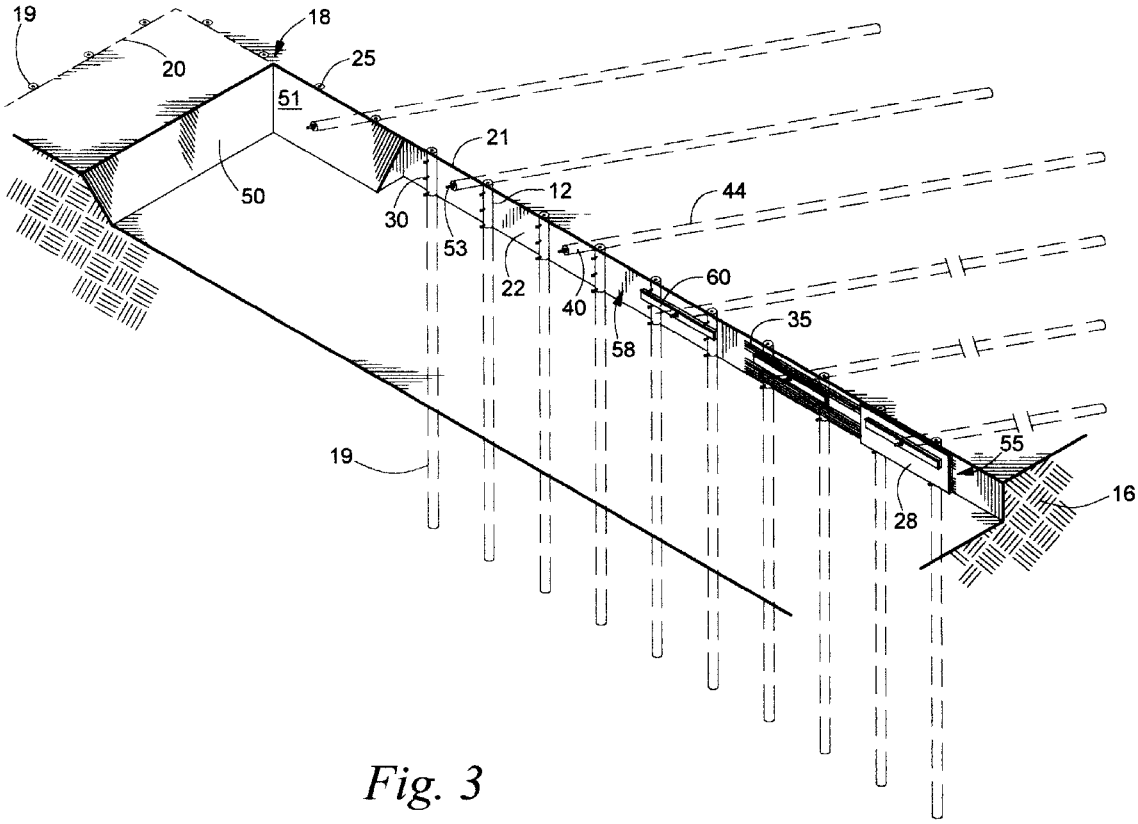
FIG. 3 is a partially sectioned perspective view of a shoring wall, according to an embodiment of this invention.
Figure 4:
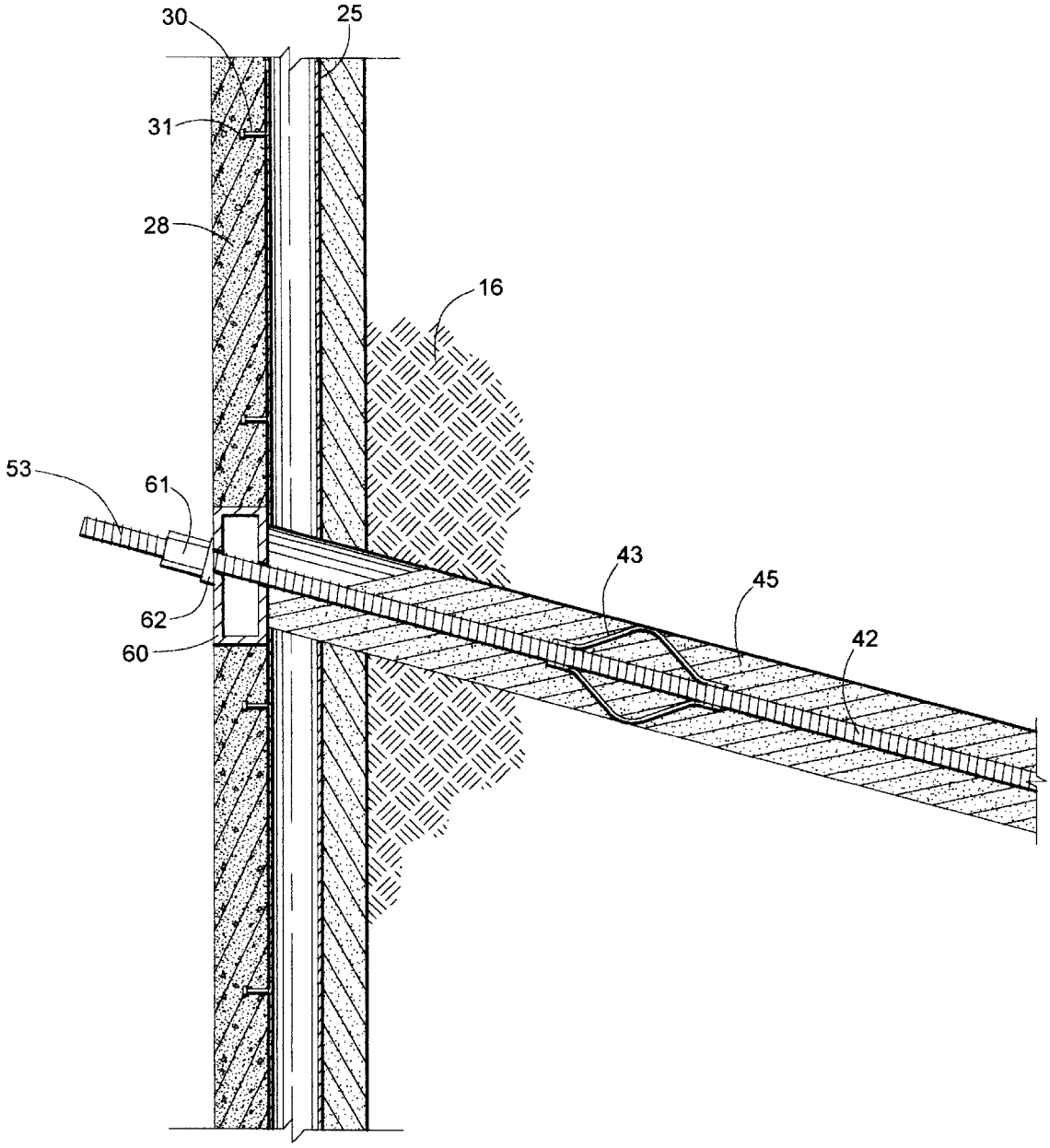
FIG. 4 is a sectioned side view of a shoring wall, according to an embodiment of this invention.
Figure 5:
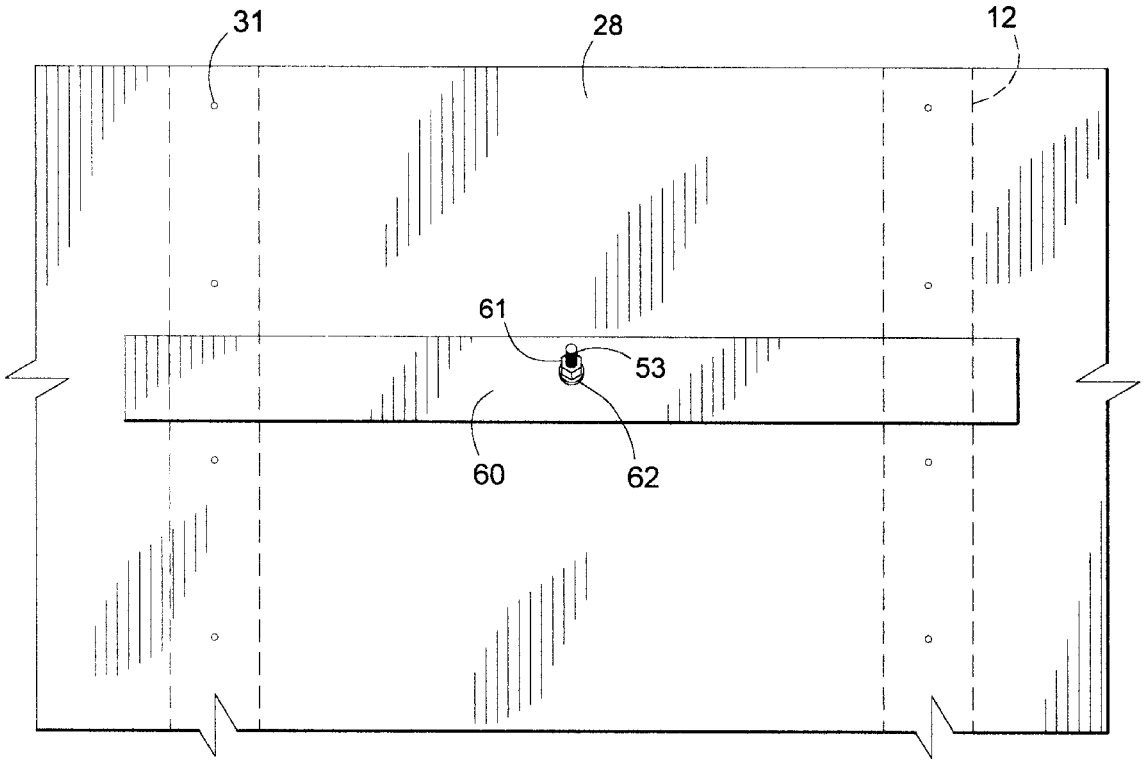
FIG. 5 is a partial front view of a shoring wall, according to an embodiment of this invention.

The preferred lean mix for the retainer grout sheath 26 is utilized to allow easy access to the retainer core 25 of the retaining element 12. This access facilitates connecting the retaining element and a facing 28 of the shoring wall 17, as shown in FIGS. 1, 3, and 4. A connection system to accomplish the connecting of the retaining element to the facing is preferably an integral part of each retaining element. The connection system permits subsequent structural attachment of the shotcrete or other facing to the retaining elements as the shoring wall is constructed.

The preferred connection system includes headed studs 30 attached along the retaining elements 12 for receiving the facing 28. The headed studs are preferably rod material with a head 31 that is welded directly to the retainer core 25. Alternatively, the headed stud could be attached to the retaining element by a threaded connection to the retainer core. Also alternatively, rebar hooks or clasps attached to the retainer core could be utilized. The hooks or clasps can be included in the core when the retainer core is first inserted into the retainer bore hole 19. The hooks or clasps are subsequently exposed by chipping away the lean mix of the retainer grout sheath proximate the headed stud's connection to the retainer core.

A lagging matrix 35, as shown in FIG. 3, is attached to the retaining elements 12 along the excavation plane 22, preferably by joining the lagging matrix to the headed studs 30 of the retaining element's connection system. The facing 28 concrete mixture is then deposited into the lagging matrix. The lagging matrix typically consists of horizontal rebar or alternatively a steel mesh.

The shoring wall 17 of the present invention also includes soil nails 40 installed at intervals along the excavation plane 22 to depths required by design. FIGS. 1, 2, 4 and 6 show the soil nails, which are preferably of a conventional configuration. The soil nails include a threaded core element 42 that receives at least two centralizers 43, as shown in FIG. 1, for maintaining the core element in the center of a nail bore hole 44. The nail bore hole also receives a nail grout sheath 45. The substantially horizontally oriented nail grout sheath serves a purpose that is similar to the vertically oriented retainer grout sheath 26. The soil nail with the grout and core element has a significant mass, and this mass allows the soil nail to tie to the shored, earthen mass 16. The soil nails can be fully bonded, passive elements as shown, or may alternatively be sleeved to allow them to have a tensile pre-stress, if required in certain circumstances.

The soil nails 40 are preferably inserted through a drill berm 50, as shown in FIG. 3. The drill berm stabilizes the exposed excavation plane 22 and is formed during the excavation of the earthen mass 16. The drill berm includes a berm face 51 that is face substantially perpendicular in relation to the nail bore holes 44 and likewise to the soil nails received into each nail bore hole.

After the soil nails 40 are inserted into the face of the excavation plane 22 the drill berm 50 can be removed back to the excavation plane. The soil nails also include tip portions 53 that remain exposed after removal of the drill berm, on the excavated side of the excavation plane.

The soil nails 40 are inserted into the excavation plane 22 at approximately the midpoint between a pair of adjacent retaining elements 12, as shown in FIGS. 2, 3, 5, 7, 8, 9 and 10. The excavated plane has an exposed face of earthen material, herein referred to as the face 58. Most preferably, as detailed in FIG. 10, every other pair of adjacent or neighboring retaining elements receives the soil nail for each "lift" or excavated row 55 of soil nails. This alternating pattern of soil nails is especially accommodating for the installation of a plurality of wales 60, which are employed to connect each of the soil nails to retaining elements.

Figure 2:
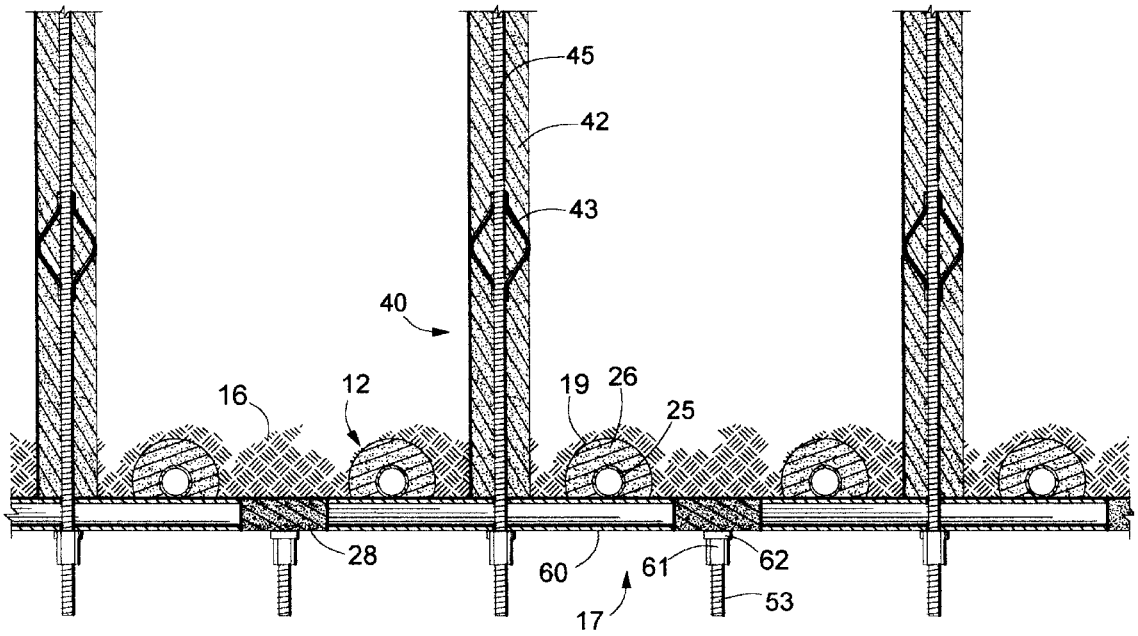
FIG. 2 is a sectioned top view of a shoring wall, according to an embodiment of this invention.

Each wale 60 attaches to the tip portion 53 of each soil nail 40, as shown in FIGS. 1 through 10 and detailed in FIG. 2. The wale connect to the tip portion of the soil nail 40 using a nut 61 and a washer 62. The wale contacts both of the adjacent retaining elements 12. To directly contact the retaining element, the portion of the retainer grout sheath 26 along the excavated face 58 is stripped away to provide a contact surface on the retaining element for the wale. The wale is a substantially horizontally oriented element that preferably has sufficient moment and shear capacity to transfer loading from the soil nails to the adjacent and supporting retaining elements.

Figure 6:
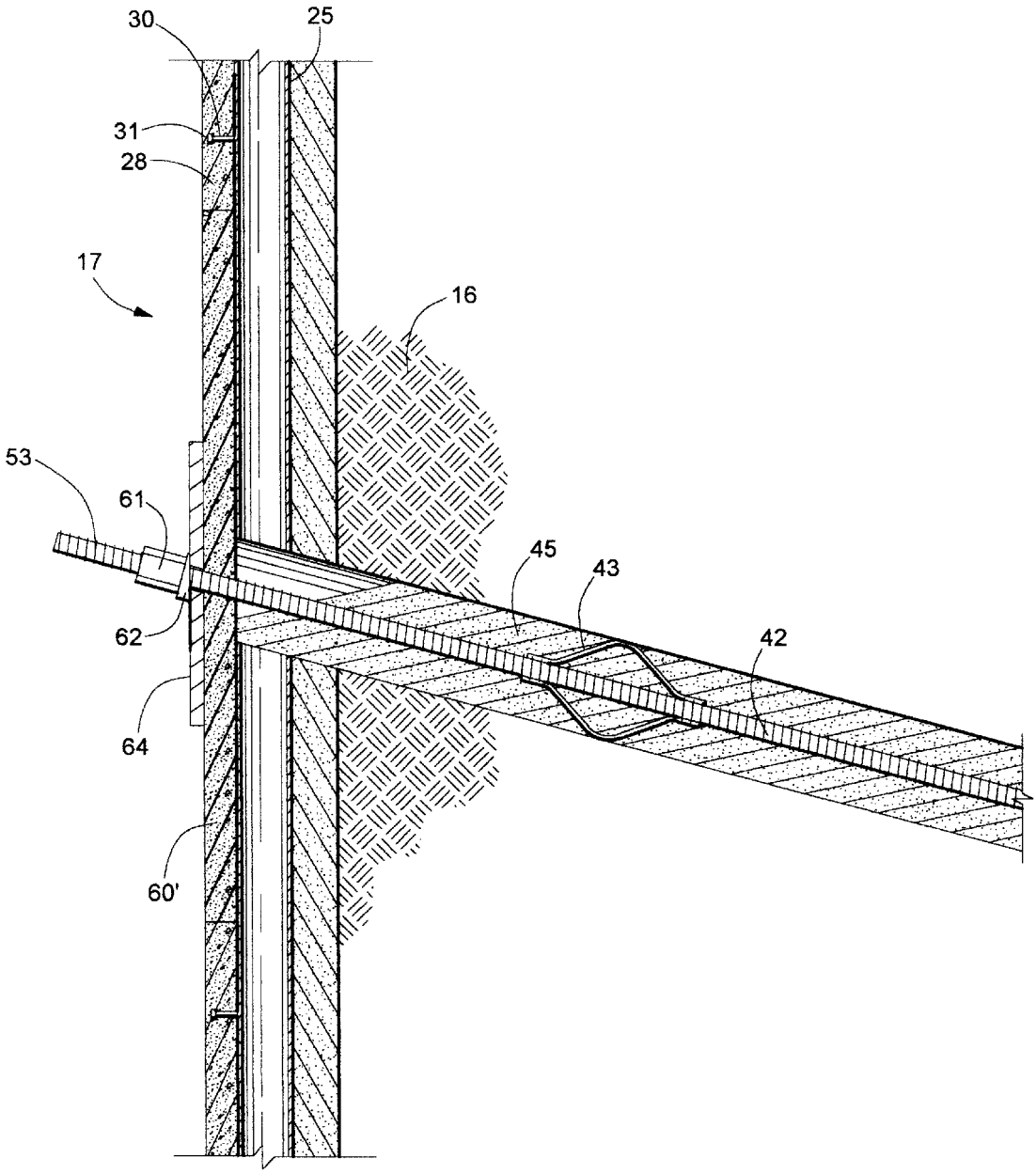
FIG. 6 is a sectioned side view of a shoring wall, according to another embodiment of this invention.
Figure 7:
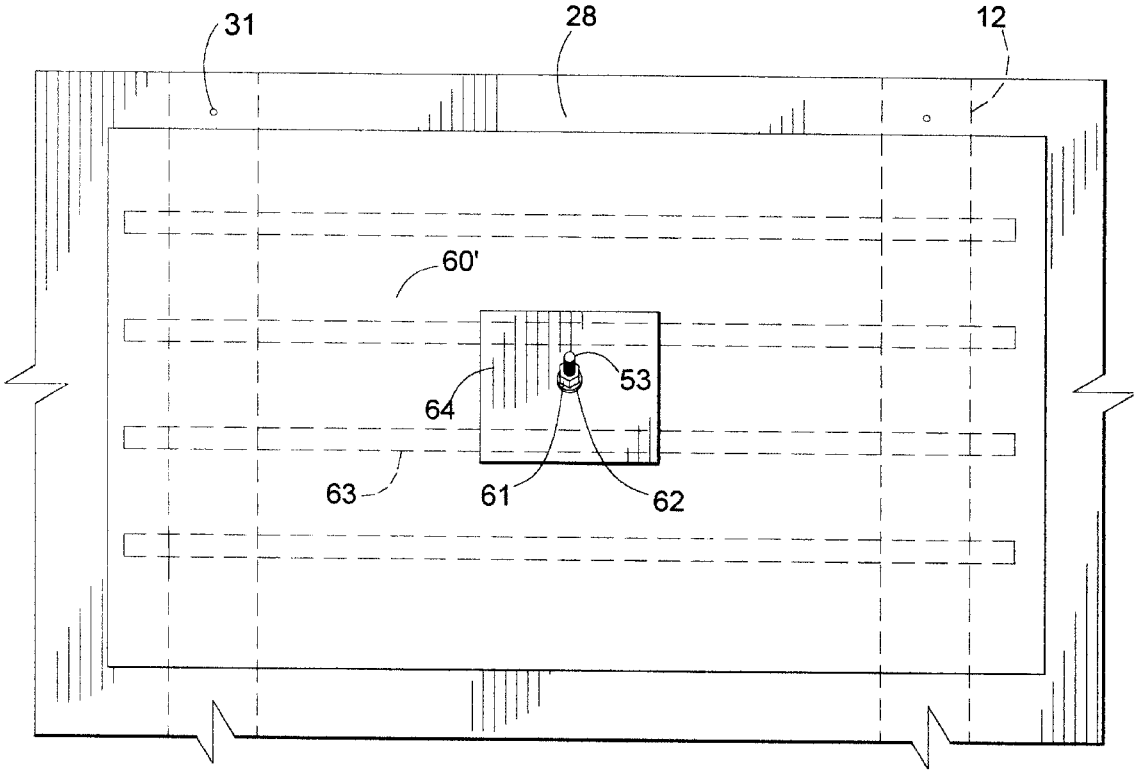
FIG. 7 is a front view of a shoring wall, according to an embodiment of this invention.
Figure 8:
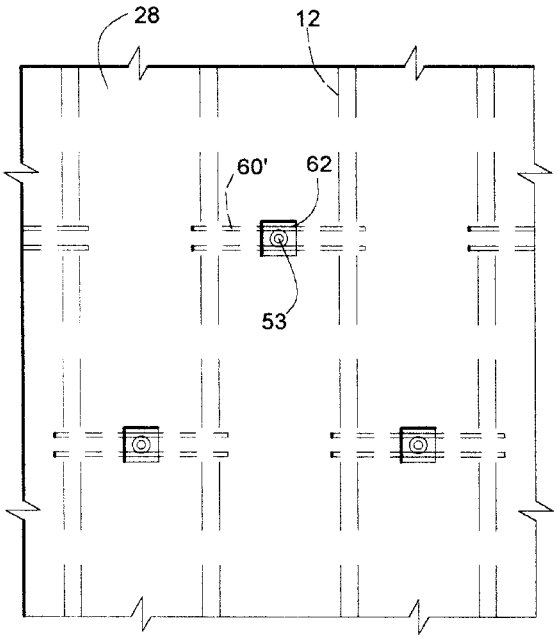
FIG. 8 is a partial front view of a shoring wall, according to an embodiment of this invention.
Figure 9:
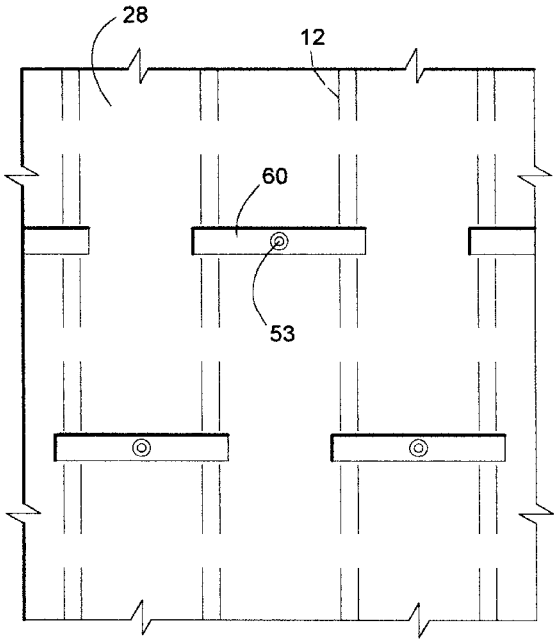
FIG. 9 is a partial front view of a shoring wall, according to another embodiment of this invention.

Each wale 60 is most preferably fabricated from structural steel, while other wale designs may be employed. As shown in FIGS. 6, 7 and 8, a reinforced shotcrete or concrete wale 60' that includes a rebar reinforcing 63, as detailed in FIG. 7, can span between retaining elements 12 and transfer soil pressures along the excavation plane 22 to the retaining elements. The concrete wale can also include a plate 64 to provide a broader contact surface for the soil nail's washer 62 to bear on the wale. The facing 28 for the concrete wales can require additional structural lagging and shotcrete, to fill in the spaces between the wales. However, as an alternative, the wale may have sufficient vertical dimension to substantially eliminate the need for structural lagging and shotcrete.

Additionally, instead of the wale 60 only contacting the retaining elements 12, the wale can be attached to each pair of adjacent retaining elements. This attachment can provide better support by the wale, but also slightly restricts the wale in relation to flexing action by the retaining elements. Two-way reinforced precast concrete wales are preferred for this alternative, in conjunction with the retaining elements, as a primary facing of the shoring wall 17. The wales bear on the retaining elements as described above. The vertical height of the wales is such that sufficient face coverage is achieved without the need for reinforced shotcrete. Some minor quantities of unreinforced in-filling shot-crete may be used to achieve full closure of the facing 28.

The pattern of wales 60 and retaining elements 12 provides a structural facing grid and is the key to the shoring wall 17 of the present invention. The tip portions 53 of the soil nails 40 are connected to the wales, and the facing grid of wales and retaining elements provides the required flexural capacity at the face of the excavation plane 22 to transfer the distributed soil pressures to the tip portions of the soil nails. The facing 28 of shotcrete, which is within the grid defined by the wales and retaining elements, is also structurally connected to the facing grid system. Because the facing lacks continuity of vertical reinforcement within the shotcrete facing, and because of the generally smaller horizontal spacing of the vertical retaining elements compared with the vertical spacing of the horizontal wales, it is structurally most efficient to provide the headed stud 30 connection between the retaining elements and the shotcrete facing, as described above. The shotcrete facing behaves as a one-way slab, spanning horizontally between adjacent retaining elements. This connection between the shotcrete facing and the retaining elements is an integral part of the support system.

Especially when the wale 60 is the reinforced shotcrete wale 60', the wale can be connected to the lagging matrix, as shown in FIGS. 7 and 8, in addition to each pair of adjacent retaining elements 12. This provides additional support of the wale by the surrounding facing 28.

The spacing of each of the plurality of retaining elements 12 along the final wall line 20, the diameter of the retainer bore holes 19 and the selection of the retainer core 25 are determined primarily by stability considerations for the excavated plane 22. The spacing and selection of the plurality of retaining elements, including the retainer cores contained within, must be such as to provide an average vertical moment capacity for the facing 28 of the shoring wall 17, consistent with the soil nail design loads, especially relating to the loads on the tip portions 53 of the soil nails. Engineering design may also account for vertical soil aching effects between the retaining elements, to reduce the required moment capacity of the retaining elements.

Figure 10:
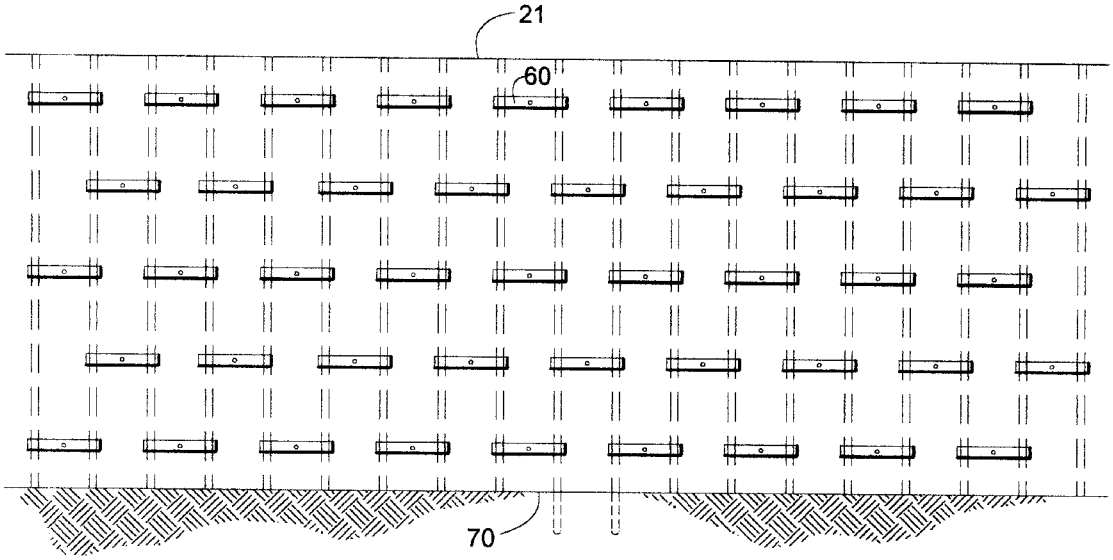
FIG. 10 is a front view of a shoring wall, according to another embodiment of this invention.

In general, the retaining elements 12 should extend to or slightly below the base 70 of the shoring wall 17, as shown in FIG. 10. However, if only the upper portion of the shoring wall requires reinforcement with retaining elements, and the soils in the earthen mass 16 in the lower shoring wall can be retained with a conventional soil nail technique, the depth of the retaining elements can be adjusted accordingly.

The retaining elements 12 initially improve the stability of the excavated face 58 by limiting the span of exposed soil in the horizontal. This limiting allows temporary excavated face support through aching action within the soil of the earthen mass 16. The retaining elements are also an integral part of the overall support system, as described in the present invention. The retaining elements have sufficient vertical moment and shear capacity such that no contribution from the face closure shotcrete is required. Again, the continuity of vertical steel in the shotcrete facing 28 is not required as it is for conventional soil nail wall facings. This latitude in the design of the vertical steel within the facing provides for design simplification and optional construction variability, as the rows of facing lifts need not be integrally tied to the location of the soil nails 40. Face stability is also enhanced by minimizing the time that the free vertical soil face is exposed. Apart from the time for face preparation activities immediately prior to face closure with shotcrete, the face will be supported by either the shotcrete or a soil berm.

As additional alternatives to the most preferred embodiments described above, the retaining elements 12 may be structurally unconnected in relation to the reinforced shotcrete as preferably accomplished by the headed stud 30 of the retaining element connector. The wales 60 still bear on the retaining elements, the grid of wales and retaining elements providing flexural capacity to the facing. However, the soil pressures within cells defined by the grid of wales and retaining elements must be supported by vertical slab action of the shotcrete facing and a continuity of vertical steel is required within the shotcrete facing, similar in this respect to a conventional soil nail wall facing.

Also alternatively, steeply inclined soil nails 40 can be used in the upper parts of the shoring wall 17, in particular, in order to avoid near surface obstructions. Alternatively, active reinforcing elements such as tie backs or anchors, are employed instead of passive soil nails, in order to limit displacement of the wall during construction. In either case, there will be a more significant vertical component of load at the tip portion 53 of the soil nail or tieback. The vertical component of the soil nail or anchor load is transferred to the retaining elements 12, via the wales 60. The retaining elements must be designed to support these vertical axial loads in compression as well as the lateral earth pressure loads in flexure.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

What is claimed is:

1. A method for shoring a face of an excavation comprising the steps of:

a) inserting a plurality of retaining elements substantially vertically into a earthen mass along a substantially straight line, the earthen mass having an upper surface, and the plurality of retaining elements defining an excavation plane, the excavation plane substantially perpendicular to the upper surface of the earthen mass;

b) excavating at least a portion of each of the plurality of retaining elements along the excavation plane to form an excavated side of the excavation plane;

c) inserting a plurality of soil nails into the excavation plane, approximately at a mid-point between a pair of adjacent retaining elements;

d) leaving a tip portion of each soil nail exposed on the excavated side of the excavation plane;

e) attaching a wale to the tip portion of each soil nail exposed;

f) contacting the wale to each retaining element of the pair of adjacent retaining elements;

g) attaching a lagging matrix to the retaining elements along the excavation plane; and h) depositing a concrete mixture into the lagging matrix to form a shoring wall.

2. The shoring method of claim 1, wherein the step of inserting a plurality of retaining elements substantially vertically into a grade includes the additional steps of:

a1) drilling a plurality of holes, each for receiving one of the plurality of retaining elements; and a2) filling each of the plurality of holes with a grout mixture.

3. The shoring method of claim 1, wherein the step of excavating along the excavation plane includes the additional steps of:

b1) forming a drill berm, the drill berm having a berm face substantially perpendicular in relation to the soil nails; and p1 b2) removing the drill berm after the soil nails are inserted into the excavation plane.

4. The shoring method of claim 1, wherein the step of contacting the wale to each pair of adjacent retaining elements includes the additional step of attaching the wale to the lagging matrix.

5. The shoring method of claim 1, wherein the step of contacting the wale to each pair of adjacent retaining elements includes the additional step of attaching the wale to each pair of adjacent retaining elements.

6. The shoring method of claim 1, wherein the step of depositing the concrete mixture into the lagging matrix includes the additional step of shooting the concrete mixture into the lagging matrix.

7. A method for shoring a face of an excavation comprising the steps of:

a) inserting a plurality of retaining elements substantially vertically into a grade to define an excavation plane, the excavation plane substantially perpendicular to the grade;

b) excavating at least a portion of each of the plurality of retaining elements along the excavation plane to form an excavated side of the excavation plane;

c) inserting a plurality of soil nails into the excavation plane, approximately at a mid-point between a pair of adjacent retaining elements;

d) leaving a tip portion of each soil nail exposed on the excavated side of the excavation plane;

e) attaching a wale to the tip portion of each soil nail exposed;

f) attaching a lagging matrix to the retaining elements along the excavation plane;

g) depositing a concrete mixture into the lagging matrix to form a shoring wall; and h) contacting the wale to the shoring wall.

8. The shoring method of claim 7, wherein the step of inserting a plurality of retaining elements substantially vertically into a grade includes the additional steps of:

a1) drilling a plurality of holes, each for receiving one of the plurality of retaining elements; and a2) filling each of the plurality of holes with a grout mixture.

9. The shoring method of claim 7, wherein the step of excavating along the excavation plane includes the additional steps of:

b1) forming a drill berm, the drill berm having a berm face substantially perpendicular in relation to the soil nails; and b2) removing the drill berm after the soil nails are inserted into the excavation plane.

10. The shoring method of claim 7, wherein the step of contacting the wale to the shoring wall includes the additional step of attaching the wale to the lagging matrix.

11. The shoring method of claim 7, wherein the step of depositing the concrete mixture into the lagging matrix includes the additional step of shooting the concrete mixture into the lagging matrix.

12. An apparatus for use in shoring a face of an excavation comprising:

a plurality of retaining elements inserted substantially vertically into an earthen mass along a substantially straight line, the earthen mass having an upper surface, and the plurality of retaining elements defining an excavation plane, the excavation plane substantially perpendicular to the upper surface of the earthen mass;

a portion of each of the plurality of retaining elements along the excavation plane forming an excavated side of the excavation plane;

a plurality of soil nails inserted into the excavation plane, approximately at a mid-point between a pair of adjacent retaining elements, each of the soil nails including a tip portion, and the tip portion of each soil nail exposed on the excavated side of the excavation plane;

a wale attached to the tip portion of each soil nail, and contacted to each retaining element of the pair of adjacent retaining elements;

a lagging matrix attached to the retaining elements retaining elements along the excavation plane; and a concrete mixture deposited into the lagging matrix to form a shoring wall.

* * * * *